United States Patent [19]

Kaminski et al.

[11] 3,954,580

[45] May 4, 1976

[54] PROCESSES FOR DECREASING MERCURY BUTTER FORMATION IN MERCURY ELECTROLYTIC CELLS

[75] Inventors: Chester J. Kaminski, Syracuse, N.Y.; Bruce T. Smith; Alfred R. Taylor, both of Brunswick, Ga.

[73] Assignee: Allied Chemical Corporation, New York, N.Y.

[22] Filed: Sept. 10, 1973

[21] Appl. No.: 395,491

[52] U.S. Cl. ..... 204/99; 204/128

[51] Int. Cl. ..... C01d 1/08

[58] Field of Search ..... 204/99, 128; 75/101 BE; 423/157

[56] References Cited

UNITED STATES PATENTS

| | | | |
|---|---|---|---|
| 2,764,472 | 9/1956 | Cady et al. | 423/192 |
| 3,078,140 | 2/1963 | Hatch | 75/101 BE |
| 3,562,123 | 2/1971 | Carlin et al. | 204/128 |

OTHER PUBLICATIONS

Japanese Patent Publication No. 40–52698, published July 24, 1973.

"Dowex :: Ion Exchange", The Dow Chem. Co., Lakeside Press, 1958, 1959, pp. 29–30.

"General Chemistry", H. H. Sisler et al., 1949, p. 374.

*Primary Examiner*—R. L. Andrews

*Attorney, Agent, or Firm*—Gerhard H. Fuchs; Jack B. Murray, Jr.

[57] ABSTRACT

Processes for decreasing mercury butter formation in mercury electrolytic cells employing brine which contains strontium wherein the brine is treated to lower the strontium content to 0.5 ppm or less. The removal of strontium from the brine may be effected by treating the brine with an ion exchange resin in sodium form to adsorb strontium thereon. Alternatively, strontium may be removed by treating the brine with a water-soluble metal hydroxide, subjecting the resulting mixture to partial evaporation to produce sodium chloride as precipitate and saturated brine solution and admixing the precipitate with water to form brine for electrolysis.

9 Claims, No Drawings

PROCESSES FOR DECREASING MERCURY BUTTER FORMATION IN MERCURY ELECTROLYTIC CELLS

BACKGROUND OF THE INVENTION

1. Field of the Invention

This invention relates to the electrolysis of sodium chloride brines and more specifically to decreasing the rate of mercury butter formation in a mercury electrolytic cell during the electrolysis therein of a sodium chloride brine containing strontium by processes wherein the strontium content is lowered to 0.5 ppm or less prior to electrolysis.

2. Description of the Prior Art

The production of chlorine by the electrolytic decomposition of sodium chloride brines is well known in the art. When such an electrolysis is performed in a mercury electrolytic cell, a thick flowing or solid material, termed "mercury butter", is generally formed on the surface of the flowing mercury cathode. This mercury butter is composed chiefly of mercury with small amounts of metallic impurities, mainly iron. The presence of the mercury butter in the electrolytic cell is undesirable in that it effects a decrease in current efficiency of the cell and increases the hydrogen content of the chlorine produced by the cell, thereby presenting a safety hazard and reducing the amount of chlorine that can be subsequently liquefied from the gases so produced. In addition, the presence of mercury butter in the cell requires purification of the mercury which becomes more complex and costly as the amount of mercury butter formed increases and presents a hygiene problem.

It has been the practice to purify sodium chloride brines prior to electrolysis in a mercury electrolytic cell so as to eliminate undesirable impurities present in the brine. A typical purification process is disclosed in U.S. Pat. No. 2,746,472 (issued in 1956 to Cady et al.). This purification process, however, produces brines containing strontium which, when electrolyzed in a mercury electrolytic cell effects the formation of an undesirable amount of mercury butter.

SUMMARY OF THE INVENTION

It has now been discovered that the presence of strontium in the sodium chloride brines is a major contributor to mercury butter formation and that prior art purification processes in failing to reduce the strontium content of brines containing strontium to 0.5 ppm or less do not sufficiently remove this contributor to mercury butter formation.

By the process of the present invention, sodium chloride brine containing strontium which is to be electrolyzed in a mercury electrolytic cell is treated to reduce the strontium content in the brine to 0.5 ppm or below. In one embodiment of the invention, the brine prior to electrolysis is passed through an ion exchange resin in the sodium form preferably containing iminodiacetate active groups, to adsorb the strontium thereon, thereby producing brine containing no more than 0.5 ppm strontium.

It has been further discovered that a brine containing no more than 0.5 ppm strontium may be obtained by adding a water-soluble metal hydroxide to the brine to be treated, and partially evaporating the resulting mixture to produce NaCl precipitate which when separated therefrom and admixed with additional water forms a brine containing strontium within the desired limit.

Due to the large tonnages of chlorine produced commercially each year in mercury electrolytic cells, the decreased mercury butter formation effected by the processes of the present invention represents a substantial cost savings in purification expenses and in loss of mercury during purification and a general improvement in cell operation. The prevention of mercury loss also decreases the pollution problem resulting from such mercury loss therefrom.

DETAILED DESCRIPTION OF THE INVENTION

Raw brines vary widely in composition, both in the NaCl content of the brine and in the amount and nature of impurities present in the brine, and generally contain from about 10 to 30 weight percent NaCl and 100 to 6,000 ppm impurities. Thus, in a raw brine containing 25 weight percent NaCl the raw brine generally also contains as impurities from about 1 to 10 ppm iron, 100 to 6,000 ppm calcium, 10 to 600 ppm magnesium, 1 to 10 ppm aluminum and from about 1 to 200 ppm strontium.

After purification of raw brine by prior art processes, a purified brine generally containing from about 10 to 30 weight percent NaCl together with 10 to 30 ppm impurities is electrolyzed. In a brine containing 25 weight percent NaCl, these impurities generally comprise from 0.01 to 1 ppm iron, 0.1 to 30 ppm calcium, 0.1 to 10 ppm magnesium, 0.1 to 10 ppm aluminum and 0.6 to 10 ppm strontium.

By the processes of the present invention the strontium concentration in sodium chloride brine is lowered at least to 0.5 ppm, and preferably to 0.3 ppm or below and still more preferably to 0.1 ppm so as to decrease the rate of mercury butter formation during subsequent electrolysis of the treated brine. The treatment by the processes of the present invention of brine containing strontium to reduce the strontium content thereof to the desired level may be effected upon either raw brine or upon brine which has been purified by prior art processes, such as the purification process disclosed in U.S. Pat. No. 2,764,472 (supra).

The treatment of the brine to reduce the strontium content thereof to the desired level may be effected by alternative processes. Thus, the untreated brine may be passed through an ion exchange resin in the sodium form whereby the strontium ions are adsorbed onto the resin, thereby effecting an effluent having no more than 0.5 ppm strontium. The ion exchange resins which may be employed must be of a type which will selectively adsorb multivalent cations such as strontium ($Sr^{++}$), $Ca^{++}$, $Mg^{++}$ and $Fe^{++}$ from a concentration solution of monovalent cations such as sodium chloride brine.

The ion exchange resins which have been found to be most effective are those containing iminodiacetate active groups. Such groups may be attached to a conventional resin matrix such as a styrene-divinyl benzene copolymer matrix, which is preferred, or a polystyrene matrix. The sodium salt of this type of resin can be represented as follows wherein R indicates the resin matrix:

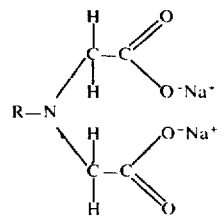

An ion exchange resin of the above formula wherein R comprises a styrene-divinyl benzene copolymer matrix is commercially available as Dowex A-1 chelating resin.

While other resins having different active groups, as for example sulfonic or carboxylic active groups, adsorb strontium, they are less efficient in selectively adsorbing strontium from a concentrated NaCl solution. Examples of these resins include Dowex 50 (Dow Chemical Company), Duolite C (Diamond Alkali Company), Duolite CS (Diamond Alkali Company), Amberlite IR (Rohm and Haas), Amberlite IRC (Rohm and Haas), Zeocarb (Permutit Co.), Permutit Q (Permutit Co.).

The operating parameters in employing the selected ion exchange resin will, of course, vary depending upon the individual characteristics of the ion exchange resin selected for use. Thus, where Dowex A-1 chelating resin is employed, the sodium chloride brine to be treated should generally have a pH greater than 7, and preferably from about 10 to 12. The untreated brine is generally passed at a flow rate of from about 1 to 10 gpm/ft$^2$ and preferably from about 3 to 5 gpm/ft$^2$ through the resin at room temperature. The bed depth of the resin will, of course, vary depending upon the flow rate of the brine through the bed, the amount of impurities present in the brines prior to treatment, the pH of the brine prior to treatment, and the concentration below 0.5 ppm strontium which is desired to be obtained in the treated brine. The bed depth of the Dowex A-1 chelating resin, for example, should generally be from about 2 to 7 ft and preferably from about 3 to 5 ft. The treatment of brine with a given quantity of resin will be continued until saturation of the resin is effected, at which point the adsorption efficiency of the resin makes further treatment of the brine uneconomical and regeneration of the resin necessary. The period of time for which a resin remains efficient in adsorbing strontium depends on the flow rate of brine through the resin, the concentration of strontium and any other multivalent cations present in the brine and other factors.

Regeneration of the selected ion exchange resin for reuse following adsorption of strontium thereon may be effected by the use of suitable regenerating agents. Thus, where Dowex A-1 chelating resin is employed as ion exchange resin, suitable regenerates are, for example, a mineral acid such as sulfuric acid or hydrochloric acid, which is employed to remove multivalent cations adsorbed on the resin during treatment and to convert the resin to $H^+$ form. Where acid concentrations of 1.0N or higher are employed, from about 1 to 3 bed volumes of the acid are generally required to effect substantially complete regeneration of the saturated ion exchange resin to hydrogen form. A solution of NaOH is then added so as to convert the resin to the $Na^+$ form in which it is to contact the untreated brine. Where a 1.5N NaOH solution is employed, from about 1 to 2 bed volumes of the NaOH solution are generally required so as to completely convert the resin to its $Na^+$ form.

Brine containing strontium may also be treated to reduce the strontium content to the desired level by the addition to the brine of a water-soluble metal hydroxide, typically an alkali metal hydroxide or barium hydroxide. While barium hydroxide may be employed effectively to remove strontium by the process of the present invention the introduction of the $Ba^{++}$ ions necessitates the removal of these ions from the brine prior to electrolysis. Therefore, the preferred water-soluble metal hydroxide is an alkali metal hydroxide. Examples of suitable alkali metal hydroxides are sodium hydroxide, potassium hydroxide or lithium hydroxide, of which the most preferred additive is sodium hydroxide. The amount of water-soluble metal hydroxide added to the brine is generally between about 0.2 and 130 grams per liter and preferably between about 0.2 and 25 grams per liter. Greater than about 130 grams of water-soluble metal hydroxide per liter does not result in a significantly greater decrease in the amount of strontium present in the treated brine, and the use of less than about 0.2 gram water-soluble metal hydroxide per liter does not effect an appreciable decrease in the strontium content in the brine thereby obtained. The water-soluble metal hydroxide may be added to the brine in either solution or solid form in order to achieve the desired concentration of water-soluble metal hydroxide therein. The temperature at which the addition of the water-soluble metal hydroxide is performed is not critical and may range from 0° to 100°C. preferably at room temperature.

After thorough mixing of the added hydroxide and the brine, the brine containing the added hydroxide is subjected to partial evaporation in a conventional evaporator whereupon a desired quantity of water is driven off from the mixture. This removal of water causes the brine to become supersaturated and thus the NaCl to precipitate. The temperature at which the evaporation is performed will, of course, be a temperature at least corresponding to the boiling point of the brine to be evaporated. Since the evaporation step may be performed either at atmospheric pressure or under vacuum, the boiling point of the brine will be dependent upon the vapor pressure employed, and is generally between about 40° and 150°C.

While sufficient water should be evaporated so as to cause the brine so treated to become supersaturated and to effect precipitation of NaCl therefrom, the amount of water to be evaporated from the brine generally ranges from about 30 to 80 weight percent of the water initially present and preferably from about 50 to 75 weight percent. The evaporation of more than about 80 weight percent results in a slurry which is too thick for ease of handling in subsequent processing, whereas evaporation of less than about 30 weight percent tends to become uneconomical.

Upon completion of the partial evaporation step the mixture remaining in the vessel consists of a slurry of solid NaCl in a saturated brine solution which contains the strontium impurities. The NaCl precipitate is removed from the slurry such as by employing a conventional centrifuge or by filtration and is then diluted with water to form a brine which contains 0.5 ppm or less of strontium for subsequent electrolysis in a mercury electrolytic cell. The amount of water to be added to the separated NaCl precipitate in order to form the brine to be electrolyzed will vary depending upon the concentration of the brine desired. Thus, where it is desired to obtain a brine having 25 weight percent NaCl, 75 milliliters of water is added for each 25 grams of separated NaCl precipitate. Alternatively, the separated NaCl precipitate may be added as make-up to a brine which contains less than the desired weight percent NaCl as a result of depletion of the brine during electrolysis. The mother liquor obtained following the separation of the NaCl precipitate from the above slurry comprises a saturated brine solution which contains the strontium impurities and the added water-soluble metal hydroxide. This mother liquor may then be recycled to the evaporator for further evaporation provided there is an adequate purge on the system.

The reason for the effectiveness of the water-soluble metal hydroxide in causing strontium to remain in the mother liquor following separation of the NaCl precipitate is not precisely known but is thought to be due to the formation of a soluble complex of the water-soluble metal hydroxide and strontium.

As mentioned above, the processes of the present invention may be effectively employed to remove strontium either from raw brines or from brines which have been purified by prior art processes. Where an ion exchange resin is employed to remove strontium from raw brine, the presence of other multivalent cations will, of course, result in more rapid saturation of the ion exchange resin employed than would be the case where strontium alone was present as impurity. Thus, where raw brine is treated with an ion exchange resin by the process of the present invention it may be necessary to employ an ion exchange resin in multiple stages wherein the effluent from the first ion exchange resin treatment is subsequently treated with a second similar ion exchange resin to effect strontium removal to the desired level of 0.5 ppm, or below. Alternatively, while the water-soluble metal hydroxide process provides a brine having no more than 0.5 ppm strontium, where raw brine is treated by the water-soluble metal hydroxide process other impurities initially present in the raw brine (such as iron, calcium and magnesium) may not be removed, thereby necessitating additional treatment of the brine as by prior art processes in order to remove the impurities other than strontium therefrom.

The processes of the present invention, which may be performed in either a batchwise or continuous manner, may be further illustrated by reference to the following examples.

EXAMPLE 1

Raw brine containing 25 weight percent NaCl together with 20 ppm strontium and 2,000 ppm other impurities is purified by the process disclosed in U.S. Pat. No. 2,764,472 to produce a purified brine containing 25 weight percent NaCl together with 1.5 ppm strontium and 1 ppm other impurities. The purified brine is electrolyzed in a mercury electrolytic cell at a rate of 16,800 pounds of brine per hour to produce chlorine at a rate of 193 pounds per hour. Mercury butter is found to be formed in the cell at a rate of about 3.0 pounds of mercury butter per ton of chlorine produced.

In a second run, the above purified brine containing 25 weight percent NaCl together with 1.5 ppm strontium and 1 ppm other impurities is passed at a rate of 4 gpm/ft$^2$ through Dowex A-1 exchange resin contained in a cylindrical vessel 3 ft in diameter to a bed height of 4 ft. The effluent from the vessel is found to contain 0.1 ppm strontium. Subsequent electrolysis of the treated brine in the above electrolytic cell effects formation of mercury butter in the cell at a rate of 0.7 pound of mercury butter per ton of chlorine produced. Thus, the lowering of the strontium concentration to 0.7 ppm effects about a 77 percent decrease in the rate of mercury butter formation.

EXAMPLE 2

The above raw brine containing 25 weight percent NaCl together with 20 ppm strontium and 2,000 ppm other impurities is passed at a rate of 3 gpm/ft$^2$ through a Dowex A-1 ion exchange resin contained in a cylindrical vessel 4 ft in diameter packed to a bed height of 4 ft. The effluent from the vessel, which is found to contain 2 ppm strontium, is passed through a second, identical vessel containing the Dowex A-1 ion exchange resin at a rate of 3 gpm/ft$^2$. The effluent from the second vessel is found to contain 0.3 ppm strontium.

Subsequent electrolysis of the treated brine in a mercury electrolytic cell effects formation of mercury butter at a rate of about 1.2 pounds of mercury butter per ton of chlorine produced, thereby effecting about a 60 percent decrease in the rate of mercury butter formation.

EXAMPLE 3

A brine purified to contain 25 weight percent NaCl together with 0.6 ppm strontium and 2 ppm other impurities is electrolyzed in a mercury electrolytic cell at a rate of 36,000 pounds of brine per hour to produce chlorine at a rate of 450 pounds per hour. Mercury butter is found to be formed at a rate of about 1.6 pounds of mercury butter per ton of chlorine produced.

In a second run, the above purified brine containing 25 weight percent NaCl, 0.6 ppm strontium and 2 ppm other impurities is admixed with 40 milliliters per liter of brine of a 2.5N solution of NaOH. The resultant mixture is thoroughly mixed and passed to an evaporator wherein 64 weight percent of the water initially contained in the mixture is evaporated therefrom at a temperature of 100°C. and a pressure of 22.5 in. Hg absolute to produce a slurry consisting of a saturated brine solution together with solid NaCl precipitate. Upon completion of the evaporation step the slurry is fed to conventional centrifuge wherein solid NaCl is separated from the brine solution. The separated solid NaCl thereby obtained is admixed with 3 milliliters of water per gram of NaCl to produce a treated brine containing 25 weight percent NaCl. Analysis of the treated brine thereby obtained reveals the presence of 0.1 ppm strontium. Subsequent electrolysis of the treated brine in a mercury electrolytic cell effects formation of mercury butter at a rate of about 0.7 pound of mercury butter per ton of chlorine produced, thereby effecting about a 56 percent decrease in the rate of mercury butter formation in the cell.

EXAMPLE 4

Raw brine containing 25 weight percent NaCl together with 15 ppm strontium and 6,000 ppm other impurities is admixed with 190 milliliters per liter of brine of a 18N solution of NaOH. The resultant mixture is passed to an evaporator wherein 64 weight percent of the water initially contained in the mixture is evaporated therefrom at a temperature of 138°C. and a pressure of 22.5 in. Hg absolute to produce a slurry consisting of a saturated brine solution together with solid NaCl precipitate. Upon completion of the evaporation step the slurry is passed to a centrifuge wherein solid NaCl is separated from the saturated brine solution. The separated solid NaCl thereby obtained is admixed with 3 milliliters of water per gram of NaCl to obtain a treated brine having 25 weight percent NaCl, and which upon analysis was found to contain 0.2 ppm strontium together with 1,000 ppm other impurities. The treated brine is then purified by the process disclosed in U.S. Pat. No. 2,764,472 in order to remove impurities other than strontium, thereby effecting a brine containing 25 weight percent NaCl, 0.2 ppm strontium and 20 ppm other impurities. Subsequent electrolysis of this brine in a mercury electrolytic cell effects mercury butter formation at a rate of about 0.9 pound of mercury butter per ton of chlorine produced in the cell.

We claim:

1. A process for decreasing the rate of mercury butter formation in a mercury electrolytic cell during electrolysis in the cell of a sodium chloride brine containing strontium in a concentration greater than 0.5 ppm, which comprises treating said brine prior to the electrolysis thereof, thereby lowering the strontium content thereof to 0.5 ppm or below.

2. The process according to claim 1 wherein said brine is treated by admixing with said brine a water-soluble metal hydroxide, partially evaporating the resulting mixture to produce sodium chloride as precipitate and saturated brine solution as mother liquor, separating said sodium chloride precipitate and admixing said precipitate with water to form a treated brine containing strontium in a concentration of 0.5, ppm or less.

3. The process according to claim 2 wherein said water-soluble metal hydroxide is admixed with the brine in an amount of between about 0.2 and 130 g/l.

4. The process according to claim 2 wherein from about 30–80 weight percent of the water content of said brine/water-soluble metal hydroxide mixture is evaporated.

5. The process according to claim 1 wherein said brine is treated by contacting said brine with an ion exchange resin in sodium form to absorb strontium thereon, said ion exchange resin containing iminodiacetate active groups.

6. The process according to claim 1 wherein said ion exchange resin contains iminodiacetate active groups attached to a styrene-divinyl benzene copolymer matrix.

7. The process according to claim 1 wherein said mother liquor is recycled to a subsequent partial evaporation step.

8. The process according to claim 1 wherein said water-soluble metal hydroxide is an alkali metal hydroxide.

9. The process according to claim 1 wherein said alkali metal hydroxide is sodium hydroxide.

* * * * *